United States Patent [19]

Will

[11] 4,260,874

[45] Apr. 7, 1981

[54] MICROPOROUS INSULATING BARRIER SYSTEM FOR ELECTRODE BOILER OUTPUT CONTROL

[75] Inventor: Fritz G. Will, Schenectady, N.Y.

[73] Assignee: General Electric Company, Schenectady, N.Y.

[21] Appl. No.: 68,918

[22] Filed: Aug. 23, 1979

[51] Int. Cl.[3] ..... H05B 3/60; F22B 1/30

[52] U.S. Cl. ..... 219/290; 219/274; 219/292; 219/293; 204/295; 338/80; 429/246; 429/254

[58] Field of Search ..... 219/284–295, 219/271–276; 122/4 A, 13 A; 338/80–86; 204/295, 296; 429/247, 249, 246, 254

[56] References Cited

U.S. PATENT DOCUMENTS

| | | | |
|---|---|---|---|
| 1,319,315 | 10/1919 | Whelan | 219/292 X |
| 1,368,212 | 2/1921 | Revel et al. | 219/285 |
| 1,376,470 | 5/1921 | Slepian | 338/86 |
| 1,446,318 | 2/1923 | Penzold | 219/290 X |
| 1,493,562 | 5/1924 | Penzold | 219/290 X |
| 1,495,465 | 5/1924 | Von Brockdorff | 219/290 |
| 1,550,164 | 8/1925 | Heinrich | 219/290 |
| 1,685,266 | 9/1928 | Baum | 219/284 X |
| 1,688,680 | 10/1928 | Baum | 219/284 |
| 2,140,516 | 12/1938 | Cowan | 219/274 |
| 2,371,475 | 3/1945 | Shelby et al. | 219/288 |
| 2,663,788 | 12/1953 | Tatem | 219/290 |
| 2,729,737 | 1/1956 | Choussy | 219/290 |
| 2,899,532 | 8/1959 | Reick | 219/274 |
| 3,138,696 | 6/1964 | Eaton | 219/286 X |
| 3,496,334 | 2/1970 | Williams | 219/288 |
| 3,864,543 | 2/1975 | Mohr | 219/285 |
| 3,877,360 | 4/1975 | Vigestrom | 219/284 |
| 3,956,020 | 5/1976 | Weininger et al. | 429/254 |
| 4,052,586 | 10/1977 | Brunner | 219/284 |
| 4,092,519 | 5/1978 | Eaton-Williams | 219/284 |

OTHER PUBLICATIONS

"Recent Development In Automatic Electrode Boilers", M. Eaton, Engineering Journal, May 1962, pp. 57–62.

Coates Electric, Bulletin 400, "Steam and Hot Water Electrode Boilers", Cam Industries; Kent, Wash.

*Primary Examiner*—Anthoney Bartis

*Attorney, Agent, or Firm*—Jane M. Binkowski; James C. Davis, Jr.; Leo I. MaLossi

[57] ABSTRACT

A pair of boiler electrodes defines a volume therebetween to be filled with electrolyte to be heated by electrical current passage between the electrodes through the electrolyte. A microporous insulating barrier permeable to the electrolyte is disposed between the electrodes to limit current flow in the electrical current path between the electrodes to a level within the maximum allowable range of the electrode material, the barrier being spaced from the surface of the electrodes at least sufficiently to prevent concentration of current on the electrode surfaces. The barrier includes channels in the vertical direction to accommodate steam removal from the electrolyte. In a particular embodiment employing concentric cylindrical electrodes having a heating space therebetween, a plurality of microporous insulating sheets spaced from each other and from each of the electrodes is disposed concentrically between the electrodes to present a high resistance electrical current path between the electrodes through the electrolyte, and a free vertical steam flow path between the concentric insulating sheets.

14 Claims, 7 Drawing Figures

MICROPOROUS INSULATING BARRIER SYSTEM FOR ELECTRODE BOILER OUTPUT CONTROL

BACKGROUND OF THE INVENTION

1. Field of the Invention

This invention relates to electric steam boilers, and particularly to electrode boilers for use with "dirty" water.

2. Description of the Prior Art

In immersion type electrode boilers, electrodes connected to an appropriate source of electrical power are either completely or partially immersed within an electrolyte to be heated to produce steam or otherwise to employ the heat so generated. The electrical current density at the electrode surfaces must be kept below that at which unacceptable electrochemical corrosion would occur. As electrical conductivity of the electrolyte employed increases (e.g., by use of high conductivity "dirty" water), electrical resistance to electrical current flow decreases, so that for given voltage the current density within the electrolyte, and consequently the electrical current density at the electrode surfaces, increases. The maximum current density tolerable by the material, e.g., stainless steel, of conventional immersion type boiler electrodes requires use of purified water, or at least water having a conductivity no greater than a certain predetermined level.

Prior art techniques for accommodating high conductivity water include that described in U.S. patent application Ser. No. 32,116, filed Apr. 23, 1979 by T.A. Keim and my earlier-filed U.S. patents application Ser. No. 34,373, filed Apr. 30, 1979, both assigned to the instant assignee, and both incorporated herein by reference. Each of the above-mentioned U.S. patent applications describes a system employing insulators to maintain electrical resistance regardless of water conductivity at such a level that the current density between the electrodes remains at acceptable values to limit electrode corrosion. The above-cited application Ser. No. 32,116 discloses a system employing an insulating wall having fluid flow paths therethrough. The above-cited application Ser. No. 34,373 discloses a system employing a porous matrix consisting of individual spheres, pellets or cylindrical rods in a porous basket disposed between boiler electrodes.

SUMMARY OF THE INVENTION

The invention described herein includes a first electrode having a major surface area as an electrolyte contact surface and a second electode having a major surface area as an electrolyte contact surface, spaced from said first electrode contact surface to define a volume between said surfaces within which electrolyte (water) to be heated is disposed during operation of the electrode boiler. An electrically insulating matrix of microporous material is configured such that a first major surface of said insulating matrix is disposed in juxtaposition with and spaced from said major surface area of said first electrode and a second major surface of said insulating matrix is disposed in juxtaposition with and spaced from said major surface area of said second electrode. For one preferred embodiment, a single microporous insulating matrix has vertical channels or gas passages to promote the escape of steam bubbles, and is disposed in the space between the two electrodes. For another preferred embodiment, a plurality of microporous sheets of electrically insulating material is disposed between the boiler electrodes, each respective layer of insulating material being separated from adjacent layers of insulating material by an open vertical space.

An object of the instant invention is to provide high resistance electrical current paths in the direction between the boiler electrodes, and simultaneously to provide a fluid flow path in the direction parallel to the boiler electrodes for escape of steam bubbles from the electrolyte.

A further object of the instant invention is to provide an insulating matrix configuration in which the overall resistance to electrical current flow between the boiler electrodes is readily controllable.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIG. 6 is a partial schematic cross-sectional view taken along line 6—6 of FIG. 1.

FIG. 7 is a partial schematic cross-sectional view taken along line 7—7 of FIG. 3.

DESCRIPTION OF THE PREFERRED EMBODIMENTS

Figure 1:
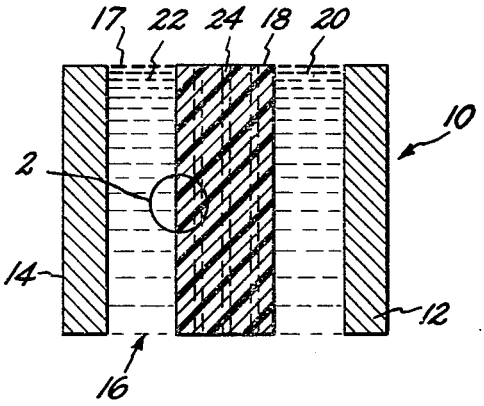
FIG. 1 is a partial schematic cross-sectional view showing an electrode boiler configuration of the instant invention.

The specific features of the invention described herein and shown in FIGS. 1–5 are merely exemplary, and the scope of the invention is defined in the appended claims. Throughout the description and FIGS. 1–5, like reference characters refer to like elements of the invention.

Figure 2:
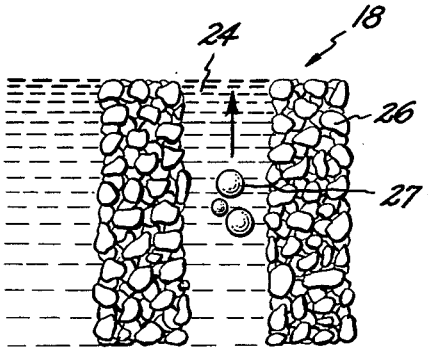
FIG. 2 is an enlarged partial cross-sectional view of a portion of the microporous matrix within circle 2 of FIG. 1.

FIGS. 1 and 2 illustrate schematically one embodiment of an electrode boiler employing the instant invention. Boiler cell 10 comprises electrodes 12 and 14 separated by a space 16 to be filled to a desired level 17 with electrolyte to be heated by passage of electrical current through the electrolyte between electrodes 12 and 14. A microporous matrix 18 is disposed in space 16 and separated from electrodes 12 and 14 by spaces 20 and 22, respectively. Matrix 18 has micropores, i.e., small openings in the material of the matrix, to allow electrolyte to impregnate matrix 18. Vertical channels 24 within the matrix material provide open paths for escape of steam bubbles generated by heating of the electrolyte within the matrix.

FIG. 2 is an enlargement of a portion of the matrix of FIG. 1. The matrix comprises a porous material made up of particles 26 bonded together to form the matrix 18. The channels 24 are disposed in a vertical direction to facilitate escape of steam bubbles 27 vertically from the matrix.

The insulating matrix is essentially a structure having vertical channels intersecting a microporous matrix. The vertical channels 24 are generally straight and have dimensions in the range of 1 to 10 millimeters to promote steam bubble release. Tortuous micropores within the matrix itself offer high resistance to flow of electrical current in the horizontal direction, which is a desirable feature. Micropore sizes may range from 100 angstroms to tens of microns. Microporosities are preferably in the range of from 1% to 5% and the percentage of cross section in a horizontal plane intersecting the channels 24 occupied by the channels, of from 3% to 10%, resulting in total porosity ranging from 4 to 15%, equivalent to packing densities of from 85% to 96%. These are identical packing densities as those achieved in a structure utilizing vertically oriented rods as described in my above-mentioned prior patent application Ser. No. 34,373. Preferred materials for microporous matrix 18 include porous polymers such as polypropylene, porous alkali-resistant glasses and porous ceramics.

The matrix may be made of a polymeric material. Producing the desired micropore size may be done by milling a surfactant and silica powder into polypropylene on a hot rolling mill, and molding the resulting mixture into the desired shape around a vertical array of thin hollow aluminum tubes. The surfactant is dissolved in water to produce the desired microporosity, and the aluminum tubes are dissolved in sodium hydroxide to produce the desired vertical channels. Preferred surfactants that have been demonstrated to create microporosity are Ivory soap and sodium benzoate as described in U.S. Pat. No. 3,956,020, issued May 11, 1976 to Weininger et al., assigned to the instant assignee, and incorporated herein by reference. The preferred amount of surfactant used is between 40% and 60% by volume to create interconnected micropores. Lower microporosities can be produced by controlled hot-pressing of the structure after leaching the surfactant but before dissolving the aluminum tubes. When using microporous polymer sheets such as polypropylene sheets, wetting of the sheet may be enhanced by incorporating within the polypropylene a small fraction by weight of glass powder. This ensures that a continuous electrolyte path through the microporous sheet will be maintained so that electrical current will readily flow through the electrolyte to heat the electrolyte and form steam within the micropores of the microporous sheets.

An alternative method of producing the present matrix consists of sintering particles of glass, such as the borosilicate glasses, or ceramic, such as alumina, magnesia and aluminosilicates, into the final desired shape with the vertical channels already included in the matrix. The microporosity of the matrix is determined by sintering temperature and duration.

During operation of the electrode boiler cell 10, volume 16 will be filled to the desired operational level 17 with an electrolyte, such as water containing a salt dissolved therein, which permeates microporous matrix 18. Electrical power is supplied to electrodes 12 and 14 from a power source (not shown) via terminals connected to electrodes 12 and 14 (not shown). The amount of heating produced in the electrolyte is a function of the resistivity of the electrolyte and the electrical current flowing through the electrolyte. For given voltage and electrolyte resistivity, output of the boiler cell (i.e., amount of steam produced per unit time by joulean heating of the electrolyte) is determined by the electrical resistance of the cell which, in turn, is controlled by the porosity and thickness of microporous matrix 18. Maximum current density permitted within the cell is limited by the maximum current density tolerable by the electrodes, conventionally made of stainless steel, as described in the aforementioned patent application of Keim, Ser. No. 32,116. Therefore, the thickness and porosity of a matrix as shown in FIGS. 1 and 2, can be selected during manufacture thereof to accommodate a certain electrolyte resistivity and cell voltage to produce a desired cell output.

Figure 3:
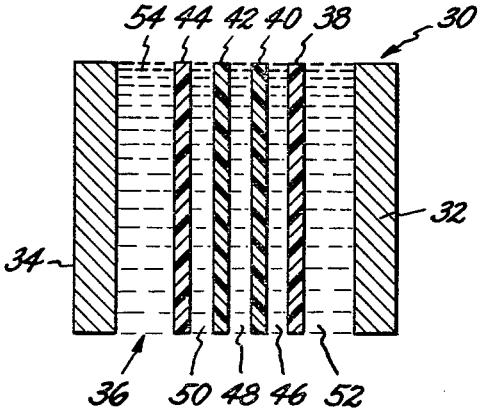
FIG. 3 is a partial schematic cross-sectional view showing a modification of the insulating matrix as shown in FIG. 1.

An alternative embodiment of my invention is illustrated in FIG. 3. Electrode boiler cell 30 comprises electrodes 32 and 34 separated by a space 36 in which electrolyte to be heated by passage of electrical current between electrodes 32 and 34 is disposed during operation of the cell 30. Disposed within space 36 is a plurality of microporous sheets 38, 40, 42 and 44 separated by spaces 46, 48 and 50. Sheet 38 is separated from the major surface of electrode 32 adjacent sheet 38 by open space 52, and sheet 44 is separated from the major surface of electrode 34 adjacent sheet 44 by open space 54. The sheets 38, 40, 42 and 44 may comprise microporous sheets of polymeric materials, such as polypropylene, fluorinated polyolefins, nylon, polyethers, polyester, polysulfone, and the like, prepared as described above. Alternatively, the sheets may comprise microporous bodies of sintered glass or ceramic materials as described above. The microporous sheets have a thickness in the range of from 0.1 to 10 millimeters and are spaced apart a distance in the range from 1.0 to 10 millimeters. During cell operation, spaces 46, 48 and 50 are filled with electrolyte and allow steam bubble escape from the electrolyte.

A particular advantage of the arrangement shown in FIG. 3 is that the number of microporous sheets may be readily changed to provide changes in overall cell electrical resistance between electrodes 32 and 34. For given cell voltage and electrolyte resistivity, boiler cell output (steam produced per unit time) is determined by the total electrical resistance of the cell. For the configuration of FIG. 3, total cell resistance is controlled by the porosity, thickness and number of microporous sheets in space 36. Cell output may be controlled by adding or removing one or more sheets, so long as adequate separation between the electrode surfaces and the sheet adjacent each, respectively, is provided to prevent current concentration at the electrode surfaces, and adequate separation between microporous sheets is provided to accommodate steam escape.

The distinct advantage of being able to increase or decrease the number of microporous sheets disposed in space 36 is that, by so doing, the overall electrical resistance of the electrolyte space may be altered to accommodate variations in electrolyte resistivity or cell output required. If high-conductivity electrolyte, e.g., electrolyte having a conductivity of greater than 500 micromhos per centimeter ("dirty" water) is to be used, a greater number of microporous sheets will be required to maintain a high electrical resistance path between the electrodes, so that current density at the electrode surfaces is limited to that which the electrodes are capable of sustaining. If lower conductivity electrolyte (e.g., "cleaner" water) is to be used, fewer microporous sheets will be required, and the output of the cell can be maintained at an appropriate level. My instant invention also provides uniform electrical resistance parallel to the plane of the electrode surfaces, since an entire microporous sheet is either removed or inserted, thereby altering the electrical resistance at each point parallel to the plane of the electrodes by very nearly the same amount. This has an advantage over the systems described in my earlier filed U.S. patent application Ser. No. 34,373, of requiring no other step, such as shakedown of spheres or rods as described in that patent application, in order to uniformly redistribute the insulating members within the electrolyte volume.

Figure 4:
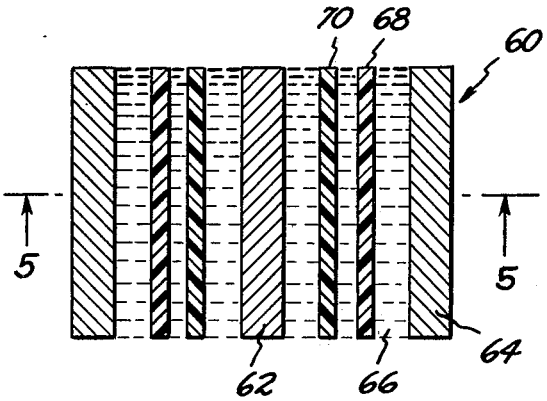
FIG. 4 is a schematic partial cross-sectional view illustrating a particular preferred embodiment of the instant invention.
Figure 5:
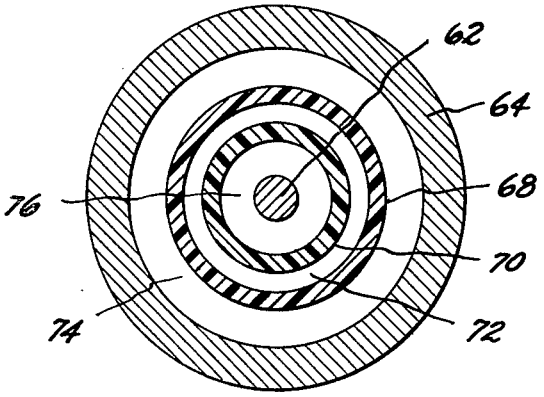
FIG. 5 is a partial schematic cross-sectional view taken along line 5—5 of FIG. 4.

The adaptation of the embodiment illustrated in FIG. 3 to cylindrical electrode boiler cells is illustrated in FIGS. 4 and 5. The cylindrical cell 60 comprises inner electrode 62 and outer electrode 64 defining annular space 66 therebetween, within which electrolyte will be disposed during operation of the cell. Two cylindrical microporous sheets 68, 70 separated by annular space 72 are shown disposed in space 66. Sheet 68 is separated from electrode 64 by annular space 74 and sheet 70 is separated from inner electrode 62 by space 76. The arrangement illustrated in FIGS. 4 and 5 has the advantage of facilitating readily changing the overall cell resistance by simply inserting additional annular microporous sheets into the space 66 or removing a microporous sheet to adjust the resistance to that necessary to accommodate the electrolyte resistivity when changes in the type of water used occur. The sheets 68, 70 illustrated in FIGS. 4 and 5 would have a thickness in the range of from about 0.1 to about 10 millimeters and would be separated by approximately 1.0 to 10 millimeters. Spaces 74 and 76 would be maintained free from microporous matrices so that maximum electrolyte heating occurs in the micropores within the volume of the microporous sheets at a predetermined spacing from the electrode surfaces, so that the temperature of the electrolyte at the electrode surfaces is below that of the electrolyte within the microporous sheets, and the electrical current density at the electrode surfaces is uniform and below that within the microporous sheets. This prevents electrochemical corrosion of the electrodes, thereby, substantially extending the useful life of the electrodes. For example, in an electrode cell having an outer diameter of 20 centimeters, the annular spaces 74, 76 would each have a minimum radial thickness of approximately 0.50 centimeters. Although electrode 62 is shown as a solid rod, in larger size cells, i.e., cells having center electrodes within an outer diameter larger than about 1 centimeter, a hollow rod would be employed to reduce the weight and material cost of the inner electrode. The radial thickness of the hollow electrode would be about 0.5 to 2.0 millimeters. Outer electrode 64 would have a radial thickness of from about 1.0 to about 5.0 millimeters.

The power dissipation rate, or rate of steam formation, can be selected within wide bounds by properly choosing matrix porosity for each of the sheets used and the thickness and number of sheets to be used, for given electrode dimensions, cell voltage and electrolyte conductivity. Increasing the number of microporous sheets, or using sheets having a greater radial thickness or lower porosity, increases the electrical resistance to current flow through the electrolyte within a matrix for a given electrolyte, thereby increasing power dissipation for given applied voltage. Conversely, reducing the number of sheets or using sheets having a lesser radial thickness or greater porosity lowers the electrical resistance and the power dissipation at constant input voltage for a given electrolyte.

By using my invention described herein, "dirty" water, i.e., water having a conductivity of greater than 500 micromhos per centimeter, can be readily accommodated with conventional boiler electrodes. Electrode life is extended, and maintenance of the cells required due to corrosion of the electrodes is significantly reduced. Because impure water can be used, the expensive water purification equipment normally employed in immersion type boilers to provide low conductivity, essentially pure, water to the boiler can be eliminated.

An inherent advantage of each of the embodiments of my invention described herein is the low resistance to escape of steam in the vertical direction, thereby facilitating electrolyte supply and steam collection, while simultaneously providing high electrical resistance current paths between the electrodes. To achieve these objectives, each microporous matrix must have dimensions adequate to extend the complete height and width (or circumference) of the electrodes used in any particular cell configuration, so that no electrolyte can bypass the microporous matrix disposed between the electrodes. Such a bypass would constitute a low electrical resistance path between the two electrodes, so that for a given input voltage, the current density in the path and at the electrode surface nearest such path could reach unacceptable levels.

Many alternative arrangements of electrodes and microporous matrix configurations could employ my invention. For example, a microporous matrix having channels as illustrated in FIGS. 1 and 2 could be made as an cylindrical matrix to be employed with cylindrical electrodes. Any number of cells of the type described herein could be employed to accommodate the electrical network available to supply power to the system and to match the electrolyte supply and steam collection equipment available. For example, a plurality of small diameter electrodes surrounded by a single large diameter electrode could be used with my invention. A particularly advantageous configuration employing my instant invention is a plurality of cells connected to a three-phase power system contained within a single pressure vessel, as described in the above-cited U.S. Patent applications Ser. No. 32,116. Practical cells could employ inner electrodes having diameters ranging from about 1.0 to about 20 centimeters and outer electrodes ranging from about 10 to about 50 centimeters and having a height ranging from about 5.0 to about 200 centimeters.

Best Mode

The best mode contemplated for application of my instant invention employs a plurality of cells having concentric electrodes as shown in FIG. 5 with a plurality of microporous annular sheets disposed between the electrodes. The preferred material for the microporous sheets is polypropylene having a porosity of 1 to 5% and a thickness of 0.1 to 10 millimeters and a separation of 1 to 10 millimeters depending on cell size. The preferred electrolyte is trisodium phosphate salt in water having a resistivity of between about 500 and 5,000 ohm centimeters.

I claim:

1. An electrode boiler cell containing an electrically-insulating matrix for control of the electrical resistance of the boiler electrolyte comprising:

a first electrode having a major surface area;

a second electrode having a major surface area, said first and second electrodes being disposed in spaced relationship with said major surface areas in juxtaposition; and an electrically-insulating matrix having first and second major surface areas substantially parallel to each other, said matrix being disposed between said first and second electrodes such that said first major surface area of said matrix is in juxtaposition with and spaced from said major surface area of said first electrode, and said second major surface area of said matrix is in juxtaposition with and spaced from said major surface area of said second electrode, the spacing between the matrix and the electrode surfaces being at least sufficient to prevent concentration of current on the electrode surfaces, said insulating matrix being comprised of a microporous material having a plurality of gas exit passages extending therein, the micropores of said microporous material being permeable to the electrolyte and interconnecting, each said gas exit passage being substantially parallel to said major surface areas of said matrix and intersecting micropores of said matrix, said matrix having dimensions sufficient to bar being by-passed by electrolyte.

2. The apparatus of claim 1 wherein:

said first electrode comprises a cylindrical electrode having a predetermined vertical height;

said second electrode comprises a cylindrical electrode having a vertical height substantially equal to the predetermined height of said first electrode; said second electrode being juxtaposed with and concentrically surrounding said first electrode and being spaced therefrom, and said insulating matrix is in the form of a hollow cylindrical insulator having a vertical height at least equal to said predetermined vertical height of said first and second electrodes, and said exit gas passages are extending generally vertically the entire vertical height of said cylindrical insulator.

3. The electrode boiler cell according to claim 1 wherein each of said gas exit passages is a channel.

4. The electrode boiler cell according to claim 1 wherein the microporosity of said matrix ranges from 1% to 5% and the volume of said gas passages ranges from 3% to 10%.

5. The electrode boiler cell according to claim 1 wherein said matrix is formed of a material selected from the group consisting of polymeric material, glassy material and ceramic material.

6. The electrode boiler cell according to claim 5 wherein said polymeric material is selected from the group consisting of polypropylene, fluorinated polyolefins, nylon, polyethers, polyesters and polysulfone.

7. The electrode boiler cell according to claim 5 wherein said glassy material is a sintered borosilicate.

8. The electrode boiler cell according to claim 5 wherein said ceramic material is selected from the group consisting of alumina, magnesia and aluminasilicates.

9. An electrode boiler cell containing an electrically insulating barrier for control of the electrical resistance of the boiler electrolyte comprising:

a first electrode having a major surface, a second electrode having a major surface, said first and second electrodes being disposed in a spaced relationship and with major surfaces in juxtaposition, and and electrically-insulating barrier being disposed between said major surfaces of said electrodes and in juxtaposition therewith, said barrier being spaced from said electrodes at least sufficiently to prevent current concentration on the electrode surfaces and being comprised of a plurality of spaced microporous sheets substantially parallel to each other and to said major surfaces of said electrodes, the microporosity of each said sheet being permeable to the electrolyte and interconnecting, each said microporous sheet having dimensions sufficient to bar being by-passed by electrolyte, said sheets being spaced from each other at least sufficiently to form gas escape paths.

10. The apparatus of claim 9 wherein:

said first electrode comprises a cylindrical electrode having a predetermined vertical height;

said second electrode comprises a cylindrical electrode having a vertical height approximately equal to said vertical height of said first electrode, said second electrode being juxtaposed with and concentrically surrounding said first electrode and being spaced therefrom; and said spaced microporous sheets being in the form of spaced hollow cylinders concentrically surrounding said first electrode.

11. The electrode boiler cell according to claim 9 wherein said microporous sheets are formed of a material selected from the group consisting of polymeric material, glassy material and ceramic material.

12. The electrode boiler cell according to claim 11 wherein said polymeric material is selected from the group consisting of polypropylene, fluorinated polyolefins, nylon, polyethers, polyesters and polysulfone.

13. The electrode boiler cell according to claim 11 wherein said glassy material is a sintered borosilicate.

14. The electrode boiler cell according to claim 11 wherein said ceramic material is selected from the group consisting of alumina, magnesia and aluminasilicates.

* * * * *